US007165906B2

(12) United States Patent
Dieudonat et al.

(10) Patent No.: US 7,165,906 B2
(45) Date of Patent: Jan. 23, 2007

(54) ROTARY APPLICATOR OF A COSMETIC PRODUCT AND DISTRIBUTOR COMPRISING THE SAID APPLICATOR

(75) Inventors: Fabrice Dieudonat, Fosses (FR); Franck Le Crosnier, Choisy-le-Roi (FR)

(73) Assignee: Alcan Packaging Beauty Services, Chevilly-Larue (FR)

( * ) Notice: Subject to any disclaimer, the term of this patent is extended or adjusted under 35 U.S.C. 154(b) by 0 days.

(21) Appl. No.: 11/401,070

(22) Filed: Apr. 10, 2006

(65) Prior Publication Data

US 2006/0228157 A1 Oct. 12, 2006

(30) Foreign Application Priority Data

Apr. 12, 2005 (FR) ..... 05 03634

(51) Int. Cl.
*A45B 11/00* (2006.01)

(52) U.S. Cl. ..... 401/127; 401/126; 401/129

(58) Field of Classification Search ..... 401/118, 401/126–130; 132/218
See application file for complete search history.

(56) References Cited

U.S. PATENT DOCUMENTS 4,056,111 A 11/1977 Mantelet 6,565,276 B1 * 5/2003 Diaz ..... 401/129

FOREIGN PATENT DOCUMENTS

| | | |
|---|---|---|
| DE | 19950665 | 5/2000 |
| EP | 0289726 | 9/1988 |

* cited by examiner

*Primary Examiner*—Tuan Nguyen
(74) *Attorney, Agent, or Firm*—Banner & Witcoff, Ltd.

(57) ABSTRACT

An applicator of a cosmetic product, typically designed to cooperate with a neck of a holder containing said cosmetic product, for example mascara, comprises a head forming a means of manually gripping said applicator, an axial stem and an application means, and is characterized in that it comprises a means of rotation of said axial stem, said means of rotation comprising a fixed part attached to said head, and a rotating part attached in rotation to said axial stem, and a manual means of activation and/or deactivation of said means of rotation, so as to form a rotary applicator, said axial stem and said application means attached to said axial stem being able to be rotated especially when a user of said applicator applies said cosmetic product, typically to the eyelashes, by manually gripping said head.

14 Claims, 8 Drawing Sheets

ROTARY APPLICATOR OF A COSMETIC PRODUCT AND DISTRIBUTOR COMPRISING THE SAID APPLICATOR

CROSS-REFERENCE TO RELATED APPLICATION

This Application claims priority to French Application No. 0503634 filed Apr. 12, 2005.

FIELD OF THE INVENTION

The invention relates to applicator cosmetic products in paste form, typically mascara for eye make up, as well as the corresponding distributors.

STATE OF THE ART

A mascara applicator is generally formed by assembling at least three parts: a part forming an external cover, a one piece part made of plastic comprising an axial stem with, at one end, an insert or a part that can be clipped onto said external cover, and, at the other end, a brush or application means designed for picking up mascara or another cosmetic product.

The distributors of cosmetic products and mascara in particular, comprise a holder forming a container for said cosmetic product or said mascara with a threaded neck equipped with a wiper, said neck cooperating with the applicator, via said cover or said insert equipped with a part with an internal thread that can be screwed onto said neck.

Typically, the container is a part made of plastic that is generally molded, and the wiper is a separate part, typically made of an elastomer, clipped onto the neck. The wiper has a diameter selected to permit the stem to pass through it and to stem the application means or the brush loaded with the product to be applied each time that the applicator is withdrawn from the container.

Problems Raised

Traditional applicators are used by manually turning the applicator several times, in order to apply the mascara to the eyelashes and to brush the eyelashes. The ergonomics of such a movement can be relatively unsatisfactory in certain cases as the applicator has to be positioned precisely with respect to the eyelashes, and furthermore the applicator has to be rotated manually.

If the traditional movement does not cause any problem to young people with complete motricity of the hands, it can cause problems for any person, typically older, who has less mobility of the hands due to either their age or by any invalidity that could affect the motricity of the hand.

However, traditional applicators associated to this standard movement lead to standard effects in terms of results, especially as concerns the depositing of the mascara and brushing of the eyelashes. The variety of the effects obtained is always sought, as are sought, for obvious commercial reasons, new applicators designed to help renew the commercial offer.

SUMMARY OF THE INVENTION

According to the invention, the applicator of a cosmetic product, typically designed to cooperate with a neck of a holder containing said cosmetic product, for example mascara, comprises a head forming a manual means of gripping said applicator, an axial stem and an application means, said axial stem being connected to said head by its upper end, and to said application means by its lower end, said axial stem and said application means having an axial direction.

This applicator is characterized in that it comprises a means of rotation of said axial stem, said means of rotation comprising a fixed part attached to said head, and a rotating part attached in rotation to said axial stem, and a manual of activating and/or deactivating said means of rotation, in order to form a rotary applicator, said axial stem and said application means attached to said axial stem being capable of being rotated on said axial direction, especially when a user of said applicator applies said cosmetic product, typically to the eyelashes, by manual gripping of said head.

This applicator overcomes the problems raised. In fact, on the one hand it considerably modifies the movement that allows the applicator to be used as the application means simply has to be held against the eyelashes, without having to worry about applying any rotary movement to the applicator, or any series of small rotary movements.

On the other hand, it is obvious that a rotation obtained by the invention is not identical to that which accompanies the usual movement, especially because, with the usual movement, the rotation of the applicator, obtained by rotation of the wrist, is accompanied by a movement or translation of the applicator, and that, as the rotation of the wrist is very limited, part of this movement, typically the end of the movement, occurs without any real rotation, so that the applicator according to the invention truly permits new effects to be obtained both as concerns the regularity of the mascara deposited as well as the brushing of the eyelashes.

Finally, the applicators according to the invention are radically different from the traditional applicators and may comprise all types of known application means.

DESCRIPTION OF THE FIGURES

In FIG. 3*a*, the head (3) comprises a rigid part (72) analogous to that of FIG. 2*a*, whereas in FIG. 3*b*, the head (3) comprises a different rigid part (72').

FIGS. 4*a* to 8*b* relate to applicators (1) in which said means of rotation (6) comprises a mechanical device (6"), typically a spiral spring (65, 65').

FIGS. 4*a* to 4*d* are axial cross sections relating to this same embodiment of applicator (1), in which said means of rotation (6) is a mechanical device (6") comprising a spring (65), preferably a spiral spring (65') typically housed between two coaxial rings, one external ring forming an external envelope (67) and an internal ring forming a central hub (66), in which the external ring (67) is attached to the moving element (70) or moving part (70'), and the internal ring (66) is attached to the axial stem (4).

In FIG. 4*a*, the spring (65) is uncoiled, in which the spirals of the spring are shown spread apart, and no manual action is exerted on said applicator (1).

In FIG. 4*b*, a rotational movement—shown by the arrow, is applied to the manual actuation means (7), in which the side skirt (80) is held in a fixed position, so that the spring is coiled (65), shown wound up with the spirals tight.

In FIG. 4*c*, analogous to FIG. 4*b*, an axial pressure (11) is exerted on the manual actuation means (7), so as to free the axial stem (4) with respect to the radial wall (83) and thus allow it to rotate.

In FIG. 4*d*, analogous to FIG. 4*c*, said axial pressure (11) continues to be exerted, the spring (65) progressively uncoils as the stem (4) turns, in which the spring is finally uncoiled as shown in FIG. 4*a*.

FIGS. 5*a*, 5*b*, 5*c* and 5*d* are partial axial cross sections, whereas FIG. 5*e* is a partial transversal cross section in the plane C—C of FIG. 5*c*.

FIG. 5*a* shows part of the upper skirt (700) of said moving part (70'), equipped with at least one internal tooth (702) or a plurality of internal teeth (702).

FIG. 5*b* shows, with regard to FIG. 5*a*, the upper part (801') of the external outer shell (8), equipped with at least on external tooth (805) or a plurality of external teeth (805).

FIG. 5*c* shows the cooperation of the external teeth (805) and the internal teeth (702), where an axial pressure (11) is exerted on said moving part (70'), whereas, in FIG. 5*d* analogous to FIG. 5*c*, wherein the axial pressure (11) has stopped, the moving part (70') has moved away to an axial distance DH upwards.

FIG. 5*e* shows the cooperation of the external teeth (805) and the internal teeth (702) whose orientation only permits relative rotation of said moving part (70') in a single direction, shown by the arrow.

FIG. 6*a* is a transversal cross sectional view along the plane B—B of FIG. 6*b*.

FIG. 6*b* is an axial cross section along the plane A—A of FIG. 6*a*.

FIGS. 7*a* to 8*b* relate to another embodiment of applicator (1) and distributor (9) also comprising, as in the case of FIGS. 4*a* to 4*d*, a mechanical device (6") equipped with a spring (65), preferably a spiral spring (65').

FIGS. 7*a*, 7*b*, 8*a* and 8*b* are axial cross sections, whereas

FIG. 7*a* is a partial view of the applicator (1) in which the spiral spring (65') is uncoiled.

FIG. 7*b* is a partial view of the distributor (9) comprising the applicator (1) of FIG. 7*a* screwed onto the neck (20) a holder (2), in which the spring (65) of the applicator is coiled.

FIG. 7*c* is a cross section along the transversal plane B—B of FIG. 7*b* showing the coupling between the axial stem (4) comprising a square section and the central orifice (706) of the same section.

FIG. 7*d* is a partial cross section along the transversal plane B'-B of FIG. 7*b* showing the cooperation of at least one tongue (709) of said lower moving part (70"), with a plurality of vertical grooves (84) formed on the internal wall of the side skirt (80), so as to permit the relative rotation of said moving part (70') only in one direction shown by the arrow, said moving lower part (70") remains attached to the neck (20) by means of drive (90) or friction means shown by the double arrows in FIG. 7*b*.

FIG. 8*a*, analogous to FIG. 7*b*, shows the applicator (1) at the end of the unscrewing movement, said moving part (70') still cooperating with said neck.

FIG. 8*b*, analogous to FIG. 8*a*, shows the applicator (1) separated from the neck (20), so as to permit the rotation of the axial stem (4) with respect to the side skirt (80).

DETAILED DESCRIPTION OF THE INVENTION

Figure 1A:
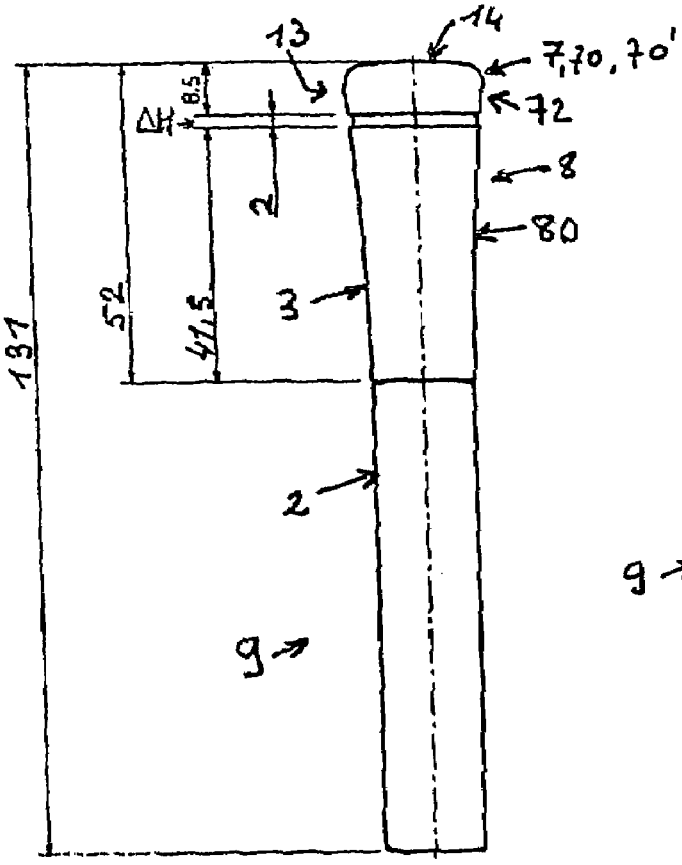
FIG. 1*a* is a side view of one side of a mascara distributor (9) comprising the applicator (1) according to the invention

According to the invention, said head (3) may comprise an outer shell (8) forming said means of manual gripping, and comprising a side skirt (80).

Typically, said manual actuation means (7) may comprise a mobile element (70) capable of being moved manually along an axial path with respect to said outer shell (8), said moving element (70) typically forming an upper portion (13) of said applicator (1), so that said moving element (70) can be moved axially by an axial pressure (11) typically exerted with the index finger in order to start said rotation, whereas said side skirt (80) is held manually between the thumb and the middle finger, so that at all times, said axial pressure (11) can be exerted on said moving element (70).

Advantageously, said moving element (70) can be associated to a recoil spring (71), so that said start of rotation only occurs when said axial pressure (11) is exerted.

Said moving element (70) may form all or part of said upper portion (13).

Figure 2A:
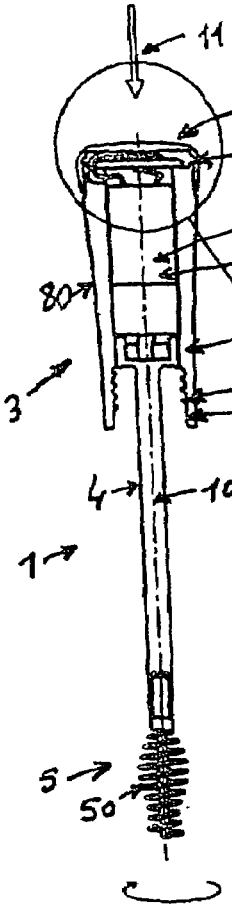
FIG. 2*a* is an axial cross sectional view of the applicator (1) of the distributor (9) of FIG. 1*b*.
Figure 2B:
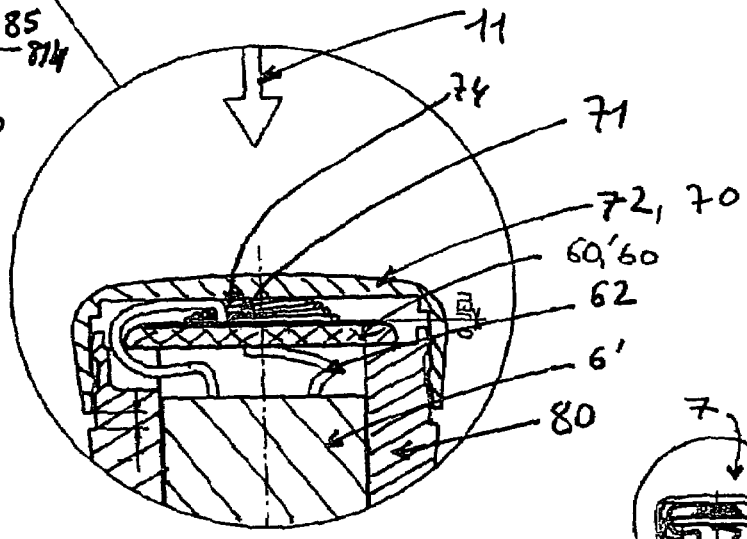
FIG. 2*b* is an enlarged view of the part of FIG. 2*a* surrounded by a circle, which shows the switch (74) of the electrical circuit (62), where the circuit is closed by the manual axial pressure (11) exerted on the end of the applicator opposite said application means, which causes the rotation of the axial stem (4) and the application means (5).

As shown for example in FIGS. 2*a* and 2*b*, said moving element (70) may form a rigid part (72), said rigid part (72) cooperating with said side skirt (80) at its upper end (800).

Figure 1B:
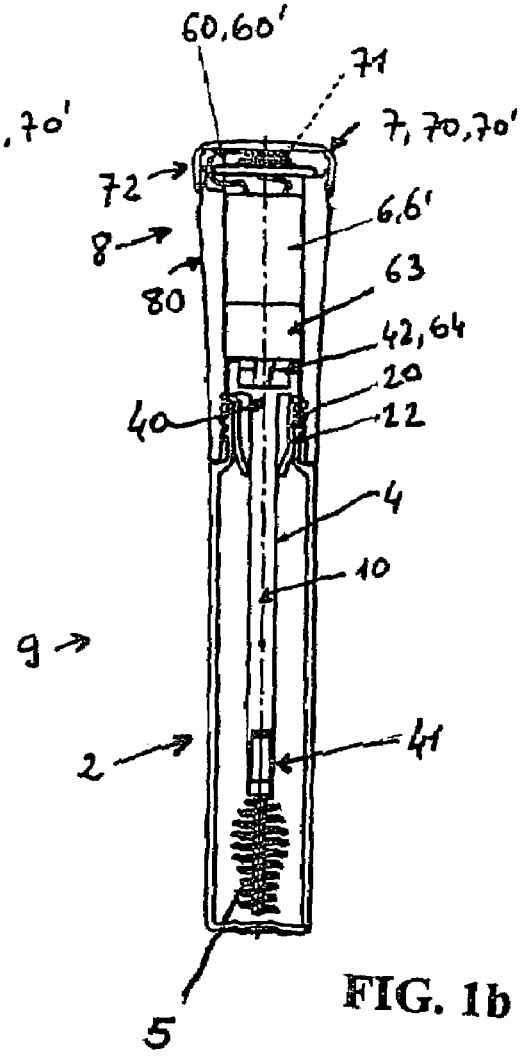
FIG. 1*b* is an axial cross section in the axial direction (10) of the distributor (9) of FIG. 1*a*.
Figure 1C:
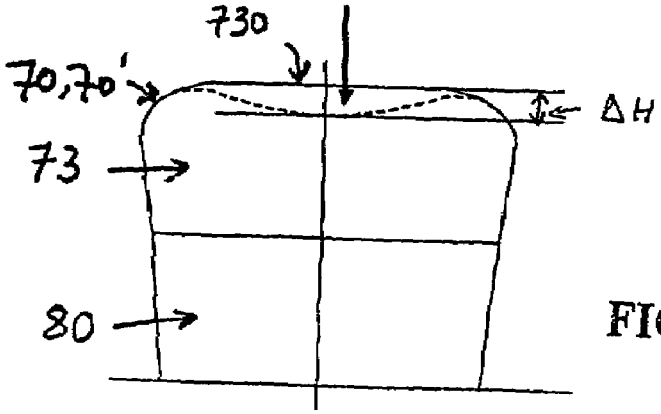
FIG. 1*c* shows a variant of the upper part of the applicator (1) and distributor (9) of FIG. 1*a*. In this variant, the moving element (70) comprises a semi-rigid or flexible part (73) equipped with a flexible arch (730), instead of a rigid part (72) capable of following an axial movement, as in the case of the applicator of FIG. 1*a*.

As shown in FIG. 1*c*, said moving element (70) may form a semi-rigid or flexible part (73) comprising a flexible wall (730), said semi-rigid or flexible part (73) cooperating with said side skirt (80) at its upper end (800).

According to the invention, said side skirt (80) can define the limit of an axial cavity (81) in which is housed all or part of said means of rotation (6), said axial cavity (81) being closed off at its upper part by said moving element (70) or said rigid (72) or semi-rigid part (73), said moving element (70) or said rigid (72) or semi-rigid part (73) being attached to said side skirt (80) at its upper end (800) typically by the cooperation of clip on means.

According to a first embodiment according to the invention, and as shown in FIGS. 1*a* to 3*b*, said means of rotation (6) may comprise an electrical motor (6'), said motor being powered, thanks to an electrical circuit (62), with an electrical current supplied by an electrical energy source (60), typically 10 by a battery (60'), said electrical motor (6') comprising a drive shaft (61) facing in said axial direction (10).

Figure 2D:
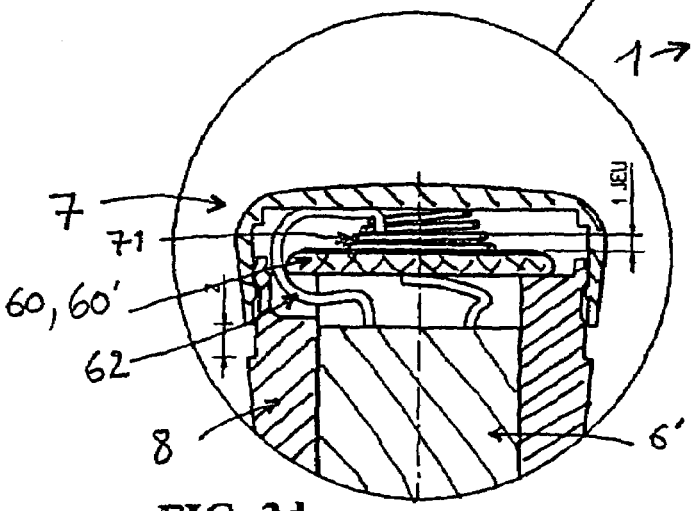
FIGS. 2*c* and 2*d* are respectively analogous to FIGS. 2*a* and 2*b*, and illustrate the case where the electrical circuit is open, so that there is no rotation of the axial stem (4) and the application means (5).
Figure 2C:
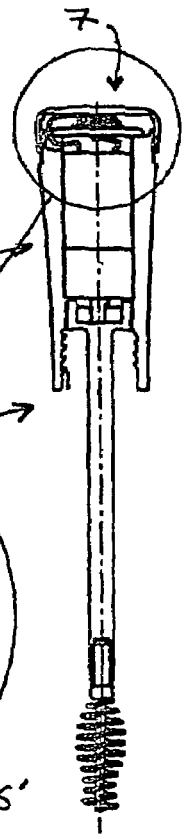
Figure 3A:
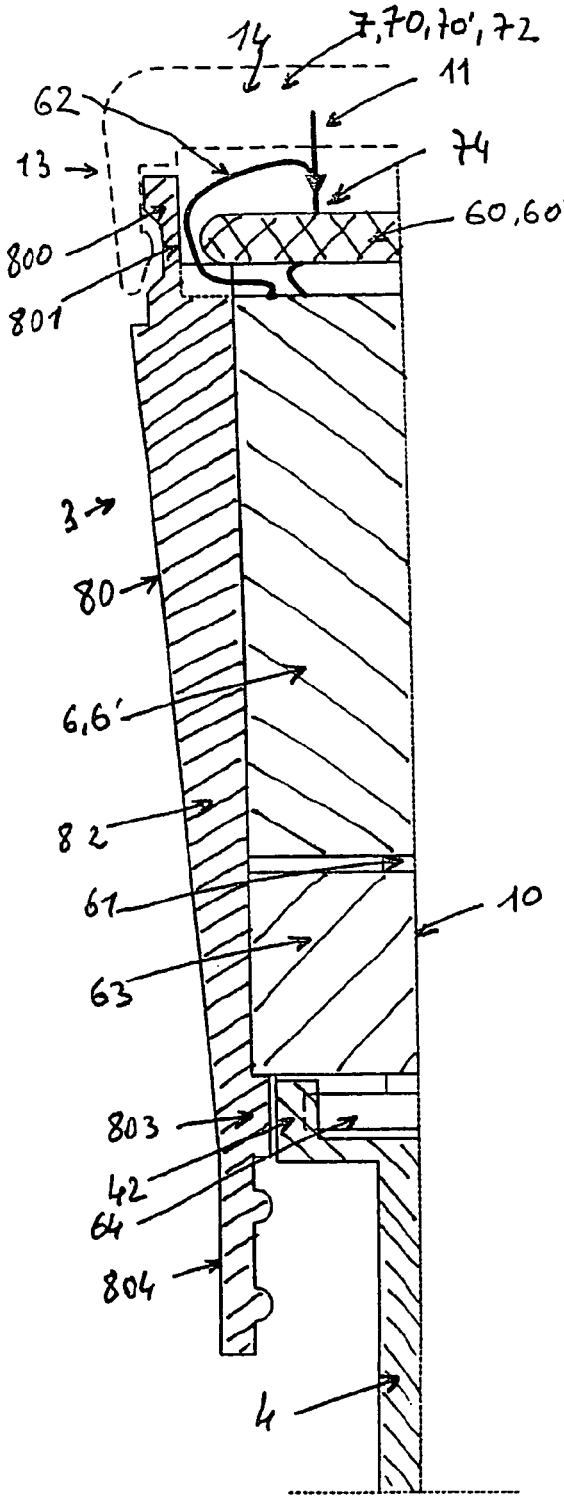
FIGS. 3*a* and 3*b* are partial axial cross sections which illustrate in detail the layout of the various components of the head (3) of the applicator (1) in the case where the means of rotation (6) comprises an electrical motor (6').
Figure 3B:
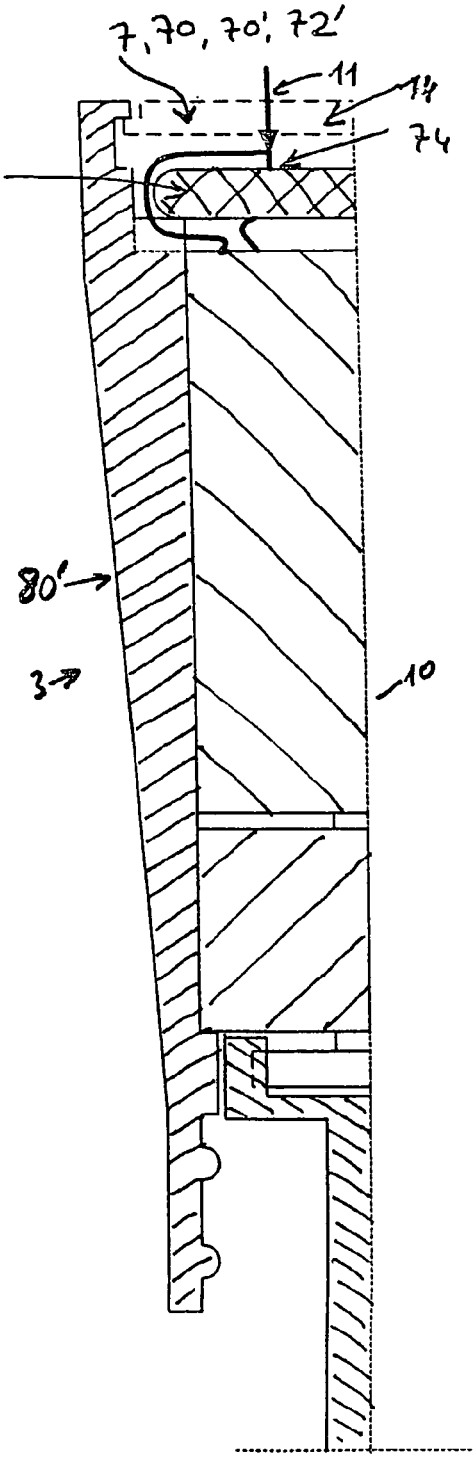
Figures 4A, 4B, 4C, 4D:
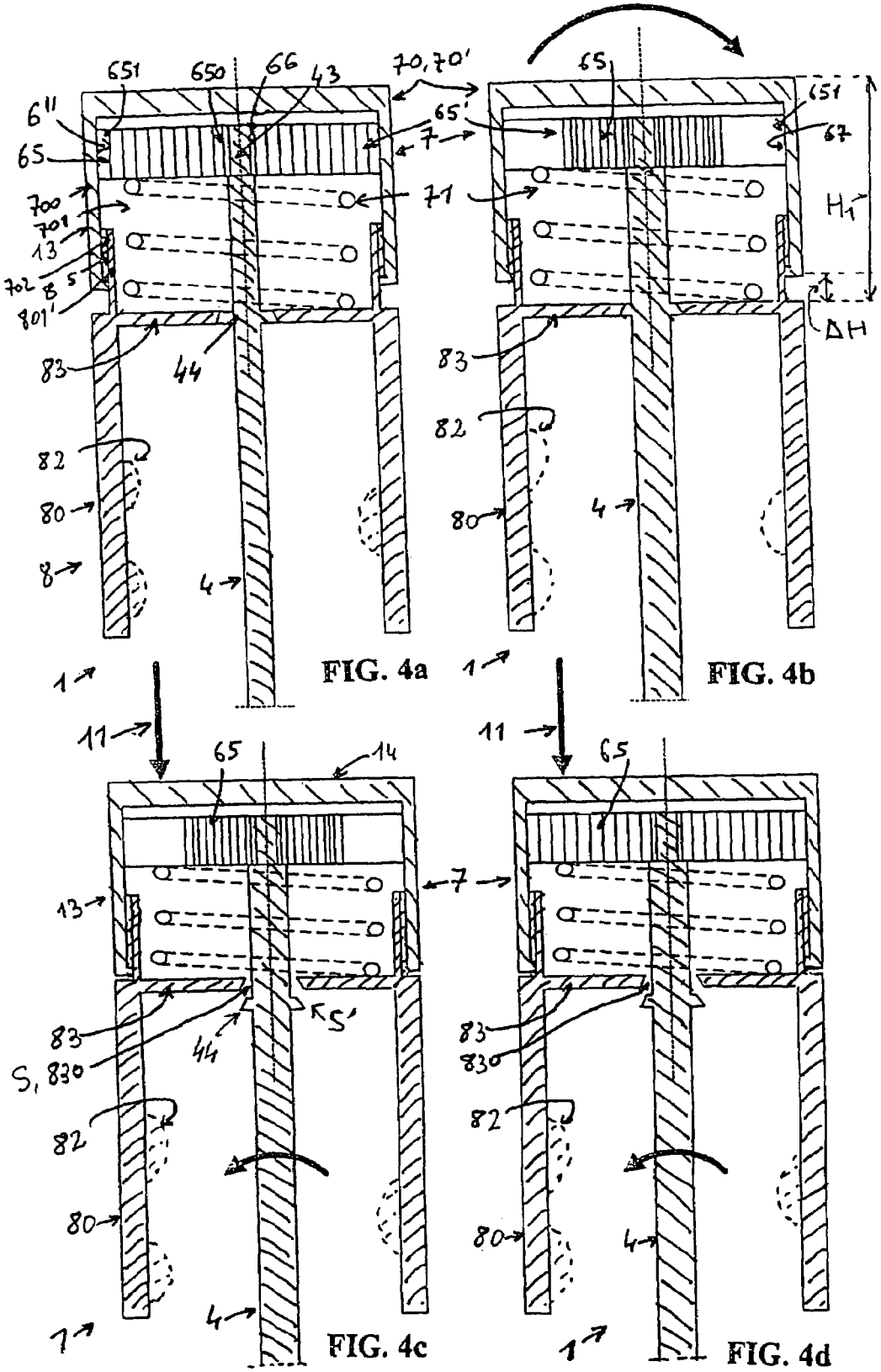
Figure 5A:
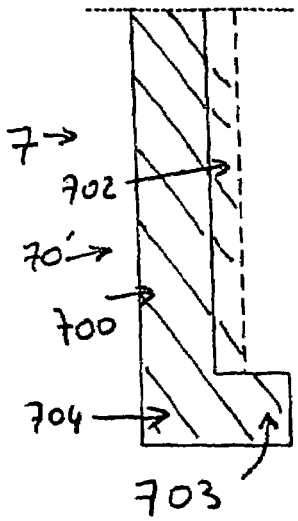
FIGS. 5*a* to 5*e* illustrate the cooperation of the moving part (70') with respect to the side skirt (80), so that said moving part (70') is attached axially to said side skirt (80), and can only turn with respect to it in a single direction.
Figure 5B:
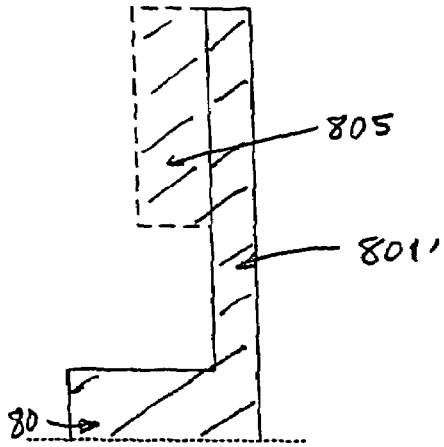
Figure 5C:
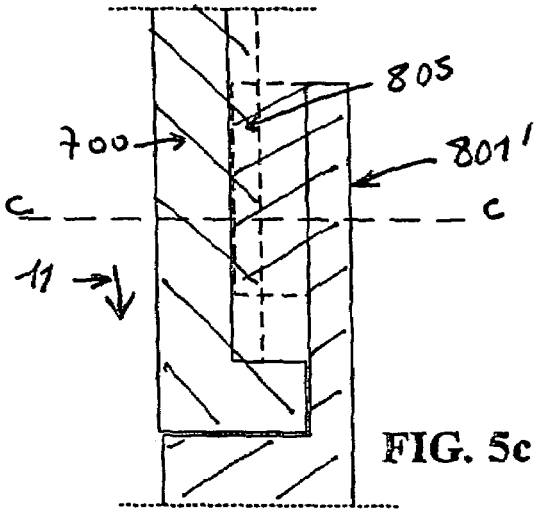
Figure 5D:
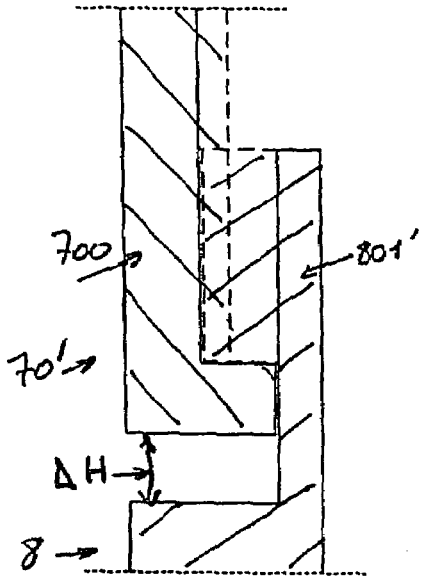
Figure 5E:
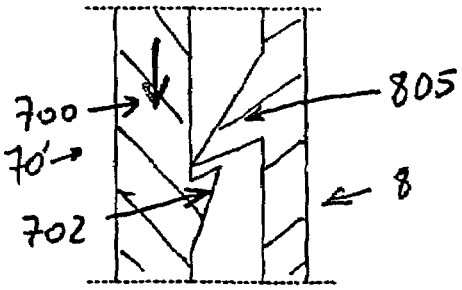

As shown in FIGS. 2*b* and 2*d*, or in FIGS. 3*a* and 3*b*, said manual actuation means (7) may comprise or form a switch (74) of said electrical current.

As shown in FIGS. 3*a* and 3*b*, said means of rotation (6) may comprise a speed reducer (63) coupled to said drive shaft (61), in order to have, for said axial stem (4) and said application means (5), at least one predetermined rotation speed 0, with respect to said head (3).

Said means of rotation (6) may comprise an upper coupling unit (64), said upper coupling unit (64) being attached in rotation to said drive shaft (61) or to said speed reducer (63), said upper coupling unit (64) being attached to a lower coupling unit (42) attached to said axial stem (4).

As shown in FIG. 3*a*, said side skirt (80) may comprise, successively from top to bottom:

an upper part (801) forming an upper cavity of internal diameter D1, typically designed to house said energy source (60) and typically said battery (60'), a central part (802) forming a central cavity of internal diameter D2<D1, typically designed to house said motor (6'), and possibly said speed reducer (63), an intermediate part (803) of internal diameter D3<D2, typically coaxial to said upper (64) or lower coupling unit (42), so as to centre said axial stem (4) with respect to said head (3), in said axial direction (10), a lower part (804), of internal diameter D4>D3, designed typically to hold an internal thread (82) in order to attach, typically by screwing, said applicator (1) to said neck (20), said neck (20) typically comprising an external thread (21).

Typically, said energy source (60) may be an electric battery (60'), said electric battery (60') being circular with a diameter typically ranging from 10 mm to 20 mm, and flat with an axial thickness typically ranging from 2 mm to 8 mm, so as to be able to easily housed in said axial cavity (81) and to occupy a small proportion of said cavity.

According to another embodiment according to the invention, and as shown in FIGS. 4*a* to 8*b*, said means of rotation (6) may comprise a mechanical device (6") comprising typically a spring (65), said mechanical device (6") being able to be rewound manually.

Figures 6A, 6B:
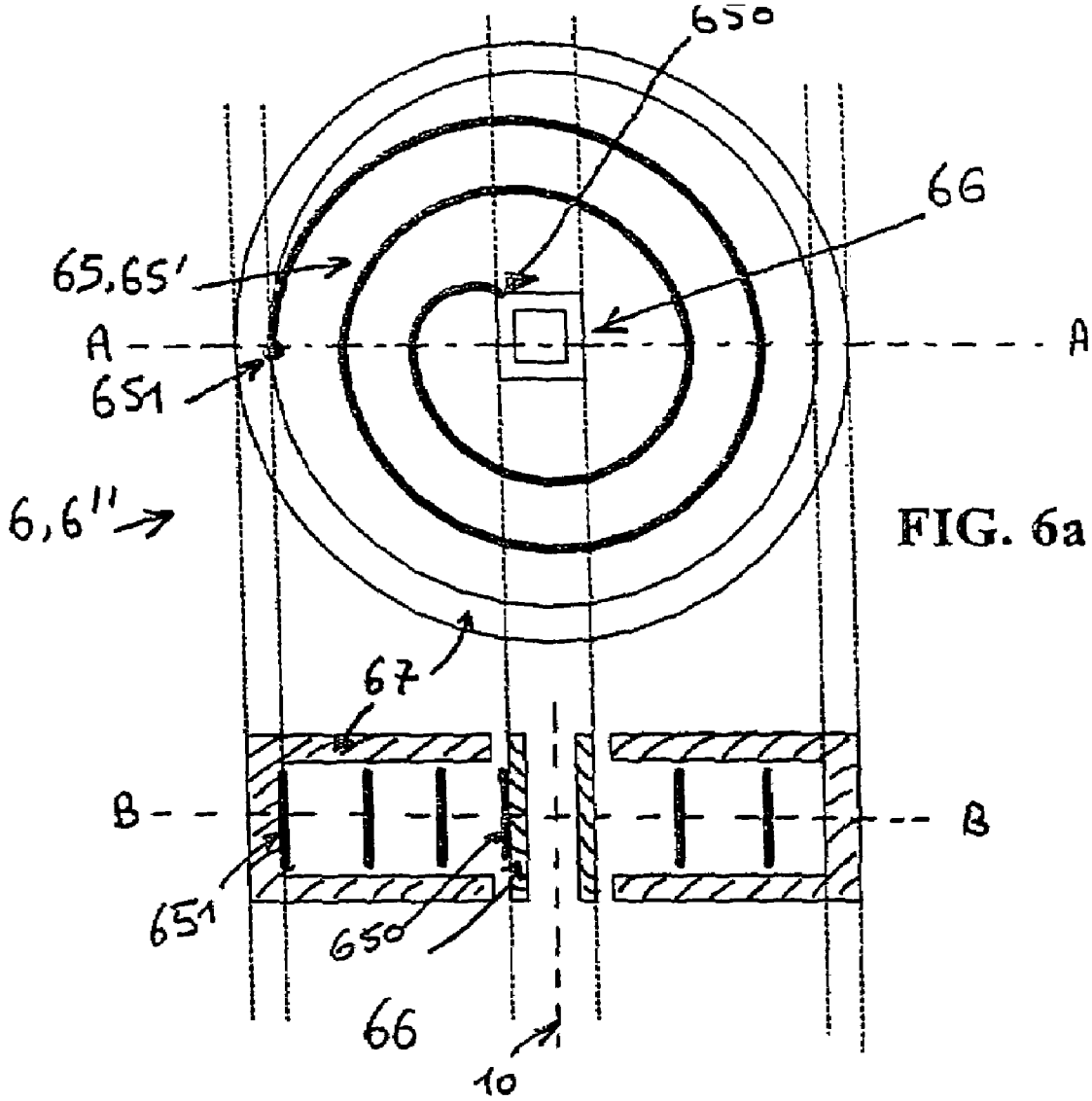
FIGS. 6*a* and 6*b* show a means of mechanical rotation (6").
Figure 7A:
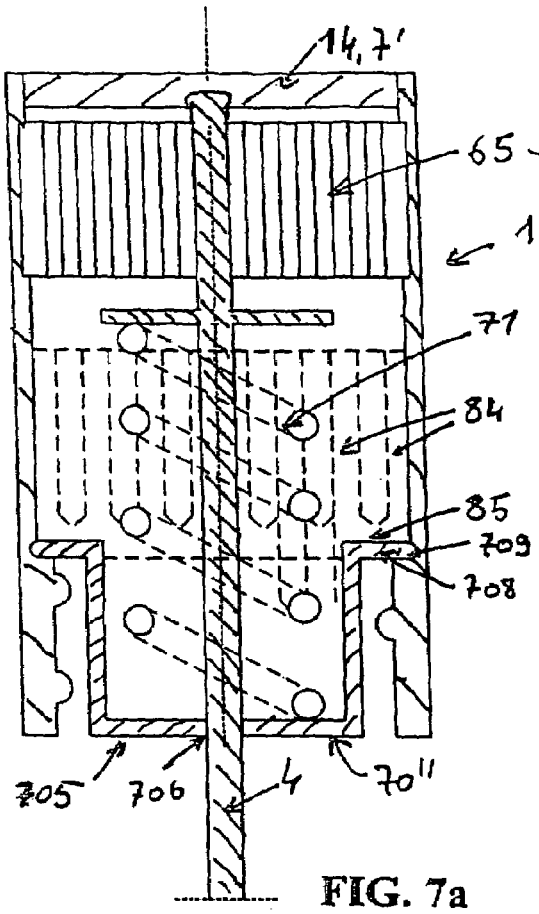
Figure 7B:
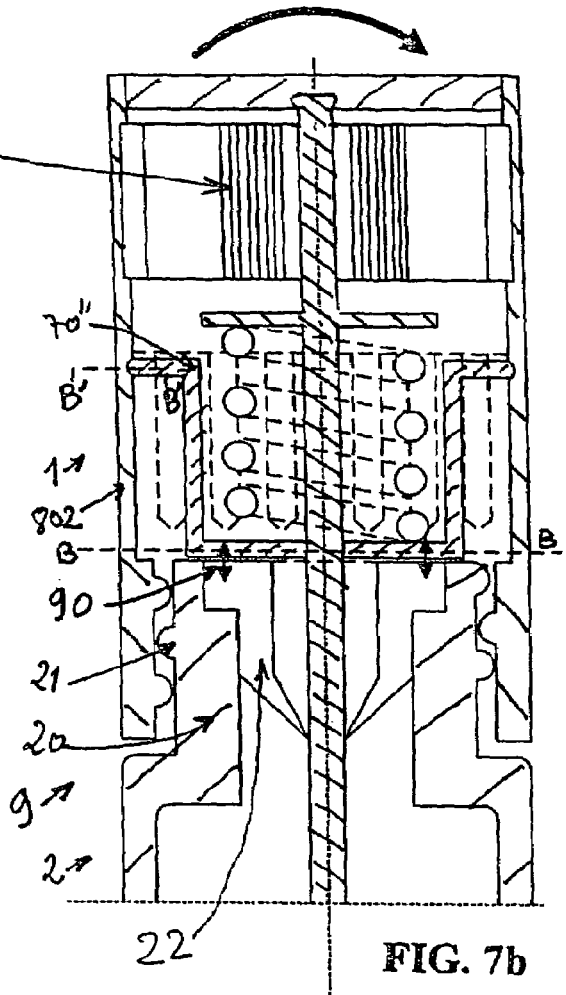
Figure 7D:
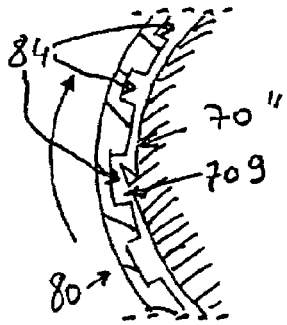
FIGS. 7*c* and 7*d* are transversal cross sections.
Figure 7C:
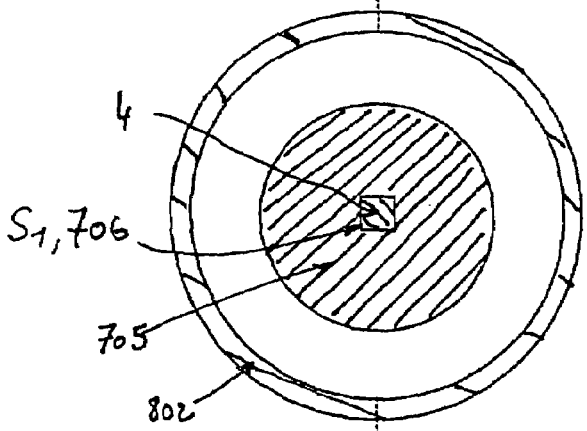

As shown in FIG. 6*a*, said mechanical device (6") may comprise a spring forming a spiral (65') whose central end (650) is attached to said axial stem (4), possibly by means of a central hub (66) facing in said axial direction (10), and whose peripheral end (651) is attached in rotation to said side skirt (80) or to said moving element (70), directly or indirectly, possibly via an external envelope (67), said central end (650) or said central hub (66) cooperating with a portion (43) of said axial stem (4), typically at its upper end (400), so that said spiral spring (65'), after being coiled or uncoiled by relative rotation of said side skirt (80) or of said moving element (70) with respect to said axial stem (4) or to said central hub (66), can uncoil by rotation of said central end (650) or of said central hub (66), so as to drive in rotation said axial stem (4).

In the applicator shown in FIGS. 4*a* to 5*e:* a) said moving element (70) may form a moving part (70') comprising an upper skirt (700) and thus forming an upper cavity (701) in which is housed said mechanical device (6"), said peripheral end (651) or said external envelope (67) of said mechanical device (6") being attached to said upper skirt (700), b) said outer shell (8) or said side skirt (80) may comprise internally a projection or a radial wall (83) forming a central orifice (830) of section S without any revolution symmetry, said projection (83) being positioned at an axial distance or height H1, c) said axial stem (4) may comprise, at said height H1, a portion (44) with a section S' more or less equal to said section S, so that said stem (4) is blocked in rotation with respect to said side skirt (80) when said portion (44) of section S' cooperates in rotation with said projection or radial wall (83) by said orifice of section S, d) said upper skirt (700) may cooperate with an upper part (801') of said side skirt (80), so that, on the one hand, by means of a toothed ratchet, with external teeth (815), typically on said upper part (801') and internal teeth (702), typically on said upper skirt (700), a relative rotation of said moving part (70') with respect to said side skirt (80) is only possible in a single direction of rotation, and that, on the other hand, by means of a lower radial edge (703) situated at the lower end (704) of said upper skirt (700), said moving part (70') may have, with respect to said side skirt (80), said axial path DH, e) said recoil spring (71) may be housed in said upper cavity (701), so as to hold said moving part (70') axially distant from said radial wall (83), said portion (44) of section S' cooperating in rotation with said central orifice (830) of section S, so that:

1) said axial stem (4) being blocked in rotation with respect to said side skirt (80), a relative rotation of said moving part (70') with respect to said side skirt (80) can allow said mechanical device (6") to be wound and said spring (65, 65') to be coiled, 2) said axial pressure (11) exerted on said moving part (70') with respect to said side skirt (80) can drive said axial path and thus detach said axial stem (4) from said side skirt (80), said portion (44) of section S' no longer cooperating with said central orifice (830) of section S, so as to free said axial stem (4) and allow it to rotate.

In the applicator shown in FIGS. 7*a* to 8*b:* a) said moving element (70) may be a lower moving part (70"), said lower moving part (70") comprising a central wall (705) equipped with a central orifice (706) of section SI without any revolution symmetry, in order to be always attached in rotation to said axial stem, a cylindrical wall (707) of height hi at least equal to the height of the thread of said lower part (804) of said side skirt (80), and a radial crown (708) equipped with flexible external tongues (709) cooperating with said side skirt (80), b) said mechanical device (6") may be housed in the axial cavity (81) formed by said side skirt (80), typically in its upper part (801), said peripheral end (651) or said external envelope (67) of said mechanical device (6") being attached to said side skirt (80), c) said axial stem (4) may comprise a radial projection (45), so as to form an upper stop for said recoil spring (71), a lower stop being formed by said lower moving part (70") and typically by said central wall (705), d) said side skirt (80) may comprise a plurality of vertical grooves (84) opening out at their lower end onto a circular groove (85), designed to cooperate with said flexible external tongues (709), said flexible external tongues (709) cooperating with said plurality of vertical grooves (84) by a toothed ratchet, so that, when said flexible external tongues (709) cooperate with said plurality of vertical grooves (84), said side skirt (80) can only turn in a single direction with respect to said lower moving part (70"), and that, when said axial pressure (11) is exerted, said flexible external tongues (709) cooperates with said circular groove (85), and that in this way said lower moving part (70") can turn in the opposite direction with respect to said side skirt (80), e) said central wall (705) of said lower moving part (70") may be cable of cooperating with said neck (20), so as to be blocked in rotation with respect to said neck (20) when said applicator (1) is screwed onto said neck (20), so that any screwing of said applicator (1) by manual rotation of said side skirt (80) with respect to said holder (2), drives said coiling of said spring (65, 65') or its winding up, and so that, after subsequent unscrewing of said applicator (1), said spring (65, 65') would thus drive in rotation said lower moving part (70") and thus that of said axial stem (4), f) said axial cavity (81) may be blocked at its upper part by an upper wall (14) axially attached to said side skirt (80).

Figure 8A:
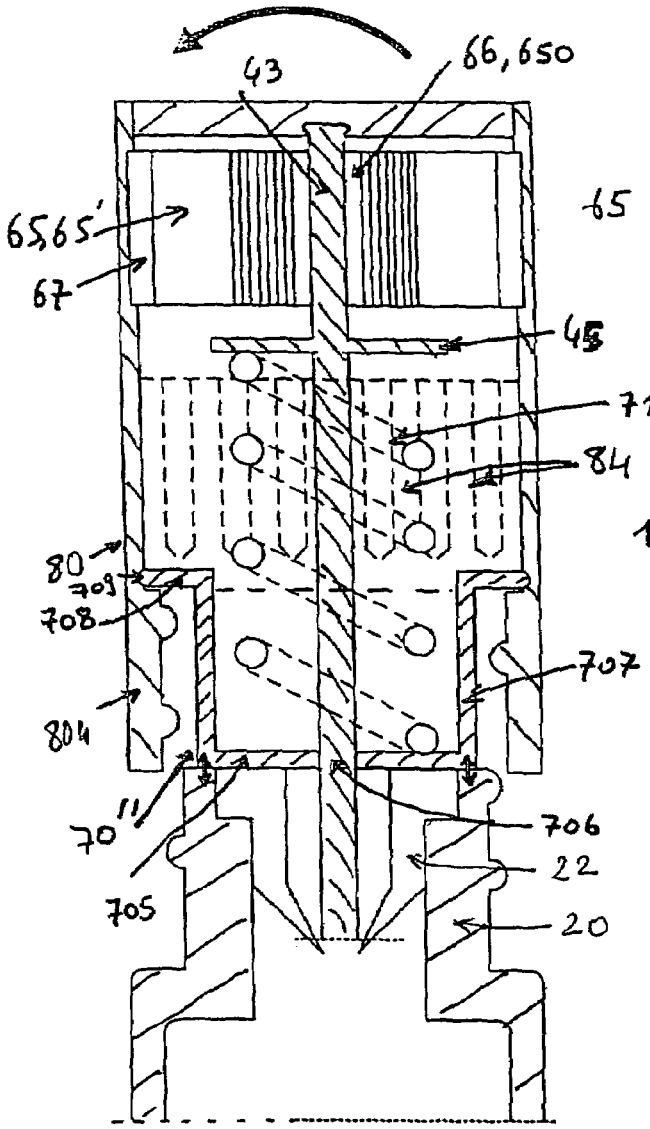
Figure 8B:
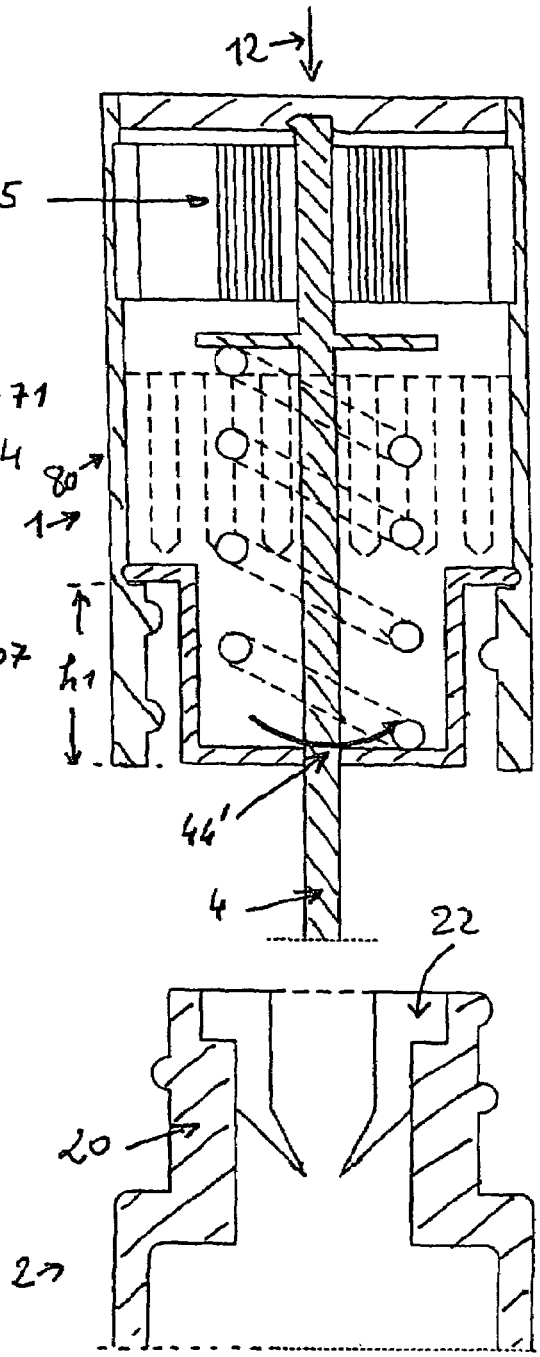

As shown in FIG. 8*b*, said upper arch (14) attached to said side skirt (81) can cooperate with an upper end (40) of said axial stem (4), so that an axial pressure (12) exerted on said upper arch (14) acts as a brake on said axial stem (4) and possibly permits its rotation to be stopped by forming a manual means of deactivation (7').

Another purpose according to the invention is formed by a distributor (9) of a product, typically a cosmetic product, for example mascara, comprising: a) said applicator (1) according to the invention, and b) a holder (2) equipped with a neck (20) and containing or designed to contain said product, said head (3) of said applicator (1) comprising a means of cooperation, typically an internal thread (82), with said neck (20) typically thanks to an external thread (21) of said neck (20), so that said applicator (1) can be screwed onto said neck (20) to close off or unscrew it for use of said applicator (1).

In the distributor shown for example in FIG. 1*b*, wherein said product is mascara, said holder (2) may comprise an wiper (22) fixed to said neck (20), so as to stem said application means (5), typically a brush (50), every time that said applicator (1) is separated from said holder (2) for use to apply make up to the eyes.

EXAMPLES OF CREATIONS

FIGS. 1*a* to 3*b* form a first embodiment of the applicator (1) according to the invention in which the means of rotation (6) is an electrical motor (6').

A first variant has been shown especially in FIG. 1*b*.

Another variant has been shown in FIG. 1*c*.

Another variant has been shown in FIG. 3*b*.

FIGS. 4*a* to 8*b* form a second embodiment of applicator (1) according to the invention in which the means of rotation (6) is a mechanical device (6") comprising a spiral spring (65').

A first variant of this second embodiment has been shown in FIGS. 4*a* to 5*e*.

A second variant of this second embodiment has been shown in FIGS. 7*a* to 8*b*.

ADVANTAGES OF THE INVENTION

The applicators (1) according to the invention are radically different from the applicators of the state of the technique. The presence of a means of rotation considerably modifies and simplifies the traditional movements, in particular that used when applying mascara.

The result is improved ergonomics and also the possibility to create special effects as concerns the brushing of the eyelashes and the application of mascara, regardless of the viscosity of the mascara.

Furthermore, the applicators (1) according to the invention can be used for all types of applications means (5) known and can, in addition, be presented in a wide range of external configurations or means of rotation, so that these applicators (1) can renew the image of traditional applicators, which is most interesting in reality.

What is claimed is:

1. An applicator of a cosmetic product, typically designed to cooperate with a neck of a holder containing said cosmetic product, for example mascara, comprising a head forming a means of manually gripping said applicator, an axial stem and an application means, said axial stem being attached to said head by its upper end, and to said application means by its lower end, said axial stem and said application means presenting an axial direction, characterized in that it comprises:

a) a means of rotation of said axial stem, said means of rotation comprising a fixed part attached to said head, and a rotating part attached in rotation to said axial stem, b) a manual means of either activation or deactivation of said means of rotation, and in that, c) said head comprises an outer shell forming said means of manually gripping, and comprising a side skirt, and d) said manual actuation means comprises a moving element capable of being moved manually along an axial path with respect to said outer shell, said moving element typically forming an upper portion of said applicator, so as to form a rotary applicator, said axial stem and said application means attached to said axial stem being capable of being rotated in said axial direction, especially when a user of said applicator applies said cosmetic product, typically on the eyelashes, by manually gripping said head, and so that said moving element can be moved axially by an axial pressure typically exerted with the index finger in order to start said rotation, whereas said side skirt is held manually between the thumb and the middle finger, so that at all times said axial pressure can be exerted on said moving element.

2. The applicator according to claim 1 in which said moving element is associated to a recoil spring, so that the rotation is only started when said axial pressure is exerted.

3. The applicator according to claim 2 in which said moving element forms either all or part of said upper portion.

4. The applicator according to claim 3 in which said moving element forms a rigid part, said rigid part cooperating with said side skirt at its upper end.

5. The applicator according to claim 3 in which said moving element forms either a semi-rigid or flexible part comprising a flexible arch, said semi-rigid or flexible part cooperating with said side skirt at its upper end.

6. The applicator according to claim 5 in which said side skirt defines an axial cavity in which is housed all or part of said means of rotation, said axial cavity being blocked off at its upper part by said moving element or said rigid or semi-rigid part, said moving element or said rigid or semi-rigid part being attached to said side skirt at its upper end typically by the cooperation of ratchet means.

7. The applicator according to claim 6 in which said means of rotation comprises an electrical motor, said electrical motor being powered through the use of an electrical circuit with an electrical current supplied by an electrical energy source, said electrical motor comprising a drive shaft facing in said axial direction.

8. The applicator according to claim 7 in which said manual actuation means comprises a switch for said electrical current.

9. The applicator according to claim 8 in which said means of rotation comprises a speed reducer coupled to said drive shaft, in order to have, for said axial stem and said application means, at least one predetermined speed of rotation with respect to said head.

10. The applicator according to claim 9 in which said means of rotation comprises a upper coupling unit, said upper coupling unit being attached in rotation to either said drive shaft or to said speed reducer, said upper coupling unit being attached to a lower coupling unit attached to said axial stem.

11. An applicator according to claim 10 in which said side skirt comprises:

a) an upper part forming an upper cavity of internal diameter D1, designed to house said energy source, b) a central part forming a central cavity of internal diameter D2<D1, designed to house said motor, and said speed reducer, c) an intermediate part of internal diameter D3<D2, coaxial to said upper or lower coupling unit, so as to center said axial stem with respect to said head, in said axial direction, and d) a lower part, of internal diameter D4>D3, designed to hold an internal thread in order to attach, typically by screwing, said applicator to said neck, said neck comprising an external thread.

12. The applicator according to claim 11 in which said energy source is an electric battery, said electric battery being circular with a diameter typically ranging from approximately 10 mm to 20 mm, and flat with an axial thickness typically ranging from approximately 2 mm to 8 mm.

13. The applicator according to claim 6 in which said means of rotation comprises a mechanical device comprising a spring, said mechanical device capable of being wound up manually.

14. The applicator according to claim 13 in which said mechanical device comprises a spring forming a spiral whose central end is attached to said axial stem, via a central hub facing in said axial direction.

* * * * *